US008638276B2

(12) United States Patent
Lee et al.

(10) Patent No.: US 8,638,276 B2
(45) Date of Patent: Jan. 28, 2014

(54) ORGANIC LIGHT EMITTING DISPLAY AND METHOD FOR DRIVING THE SAME

(75) Inventors: An-Su Lee, Yongin (KR); Myung-Ho Lee, Yongin (KR); June-Young Song, Yongin (KR); Kyoung-Soo Lee, Yongin (KR); Myoung-Seop Song, Yongin (KR); Yun-Tae Kim, Yongin (KR); Jong-Soo Kim, Yongin (KR); Min-Cheol Kim, Yongin (KR); Jung-Keun Ahn, Yongin (KR); Hun-Tae Kim, Yongin (KR); Sang-Kyun Cho, Yongin (KR); Hye-Jin Shin, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 335 days.

(21) Appl. No.: 12/495,769

(22) Filed: Jun. 30, 2009

(65) Prior Publication Data

US 2010/0007674 A1 Jan. 14, 2010

Related U.S. Application Data

(60) Provisional application No. 61/079,762, filed on Jul. 10, 2008.

(51) Int. Cl.
*G09G 3/30* (2006.01)

(52) U.S. Cl.
USPC ..... 345/76; 345/82

(58) Field of Classification Search
USPC ..... 345/76, 77, 82, 83
See application file for complete search history.

(56) References Cited

U.S. PATENT DOCUMENTS

| | | | | |
|---|---|---|---|---|
| 4,791,415 | A | 12/1988 | Takahashi | |
| 4,822,142 | A | 4/1989 | Yasui | |
| 5,006,840 | A | 4/1991 | Hamada et al. | |
| 5,311,205 | A | 5/1994 | Hamada et al. | |
| 6,919,691 | B2 * | 7/2005 | Mizukoshi et al. | 315/169.1 |
| 2003/0146887 | A1 | 8/2003 | Mametsuka | |
| 2004/0036706 | A1 | 2/2004 | Endou | |
| 2004/0140983 | A1 | 7/2004 | Credelle | |
| 2004/0222999 | A1 * | 11/2004 | Choi et al. | 345/589 |
| 2004/0246241 | A1 | 12/2004 | Sato et al. | |

(Continued)

FOREIGN PATENT DOCUMENTS

| | | | |
|---|---|---|---|
| CN | 1565013 | A | 1/2005 |
| CN | 1848218 | A | 10/2006 |

(Continued)

OTHER PUBLICATIONS

European Search Report dated Nov. 10, 2010, for corresponding European Patent application 09165170.3, noting listed references in this IDS.

(Continued)

*Primary Examiner* — Chanh Nguyen
*Assistant Examiner* — Roy Rabindranath
(74) *Attorney, Agent, or Firm* — Christie, Parker & Hale, LLP

(57) ABSTRACT

In an organic light emitting display, a gamma can be applied according to color regardless of the sequence of data output from a data driver, even if a separate gamma by color is used. A method for driving the organic light emitting display is also provided.

9 Claims, 5 Drawing Sheets

(56) References Cited

U.S. PATENT DOCUMENTS

| | | | | |
|---|---|---|---|---|
| 2005/0017931 | A1* | 1/2005 | Toyoshima et al. | 345/76 |
| 2005/0231409 | A1 | 10/2005 | Yamaguchi et al. | |
| 2006/0071884 | A1* | 4/2006 | Kim | 345/76 |
| 2006/0227082 | A1 | 10/2006 | Ogata et al. | |
| 2006/0232183 | A1 | 10/2006 | Park et al. | |
| 2006/0232520 | A1* | 10/2006 | Park et al. | 345/76 |
| 2007/0229554 | A1 | 10/2007 | Kawasaki et al. | |
| 2008/0088548 | A1* | 4/2008 | Lee et al. | 345/77 |
| 2008/0094381 | A1 | 4/2008 | Hiratsuka | |
| 2008/0150874 | A1 | 6/2008 | Kida et al. | |
| 2009/0073093 | A1* | 3/2009 | Yamazaki | 345/76 |

FOREIGN PATENT DOCUMENTS

| | | | |
|---|---|---|---|
| CN | 101044544 | A | 9/2007 |
| CN | 101202003 | A | 6/2008 |
| JP | 09-297994 | | 11/1997 |
| JP | 2003-043520 | | 2/2003 |
| JP | 2003-255900 | | 9/2003 |
| JP | 2005-300784 | | 10/2005 |
| JP | 2006-113151 | | 4/2006 |
| JP | 2006-113162 | | 4/2006 |
| JP | 2006-284972 | | 10/2006 |
| JP | 2006-317898 | | 11/2006 |
| JP | 2008-102345 | | 5/2008 |
| KR | 10-2006-0008644 | A | 1/2006 |
| KR | 10-2008-0000417 | | 1/2008 |
| KR | 10-2008-0067489 | A | 7/2008 |
| TW | I280556 | | 5/2007 |

OTHER PUBLICATIONS

Office Action dated May 25, 2011 of the Korean Patent Application No. 10-2009-0003271, which claims priority of the corresponding U.S. Appl. No. 61/079,018 and U.S. Appl. No. 12/495,769, 2 pages.

Office Action dated May 25, 2011 of China Patent Application No. 200910151057.0 which claims priority of the corresponding U.S. Appl. No. 61/079,018, 9 pages.

KIPO Office action dated Sep. 28, 2010 in corresponding application KR 10-2009-0003271, listing the cited references in this IDS.

European Search Report dated Sep. 8, 2009, for corresponding European application 09165170.3, noting listed references in this IDS.

SIPO Office action dated Feb. 21, 2012, for corresponding Chinese Patent application 200910151057.0, 9 pages.

Japanese Office action dated Feb. 7, 2012, for corresponding Japanese Patent application 2009-162005, 2 pages.

Japanese Office action dated May 29, 2012, for corresponding Japanese Patent application 2009-162005, (1 page).

European Office action dated Nov. 30, 2012 for corresponding European Patent Application No. 09165170.3, 7 pages.

Taiwan Office action dated Jun. 27, 2013, with English translation, for corresponding Taiwan Patent application 098122882, (17 pages).

* cited by examiner

ORGANIC LIGHT EMITTING DISPLAY AND METHOD FOR DRIVING THE SAME

CROSS-REFERENCE TO RELATED APPLICATIONS

This application claims priority to and the benefit of U.S. Provisional Application No. 61/079,762 filed Jul. 10, 2008, the entire content of which is incorporated herein by reference.

BACKGROUND

1. Field of the Invention

Embodiments of the present invention relate to an organic light emitting display and a method for driving the same.

2. Discussion of Related Art

Recently, various flat panel displays having a lighter weight and a smaller volume than that of a cathode ray tube, have been developed. The flat panel displays include a liquid crystal display, a field emission display, a plasma display panel, an organic light emitting display, etc.

Among others, an organic light emitting display has various advantages such as an excellent color reproducibility, a slimness, etc. so that its applications are rapidly expanding to a PDA, an MP3, etc. in addition to a cellular phone.

The organic light emitting display displays an image using an organic light emitting diode (OLED) whose brightness is determined corresponding to the amount of input current.

The organic light emitting diode includes red, green, or blue light emitting layer located between an anode electrode and a cathode electrode and has brightness determined according to the amount of current flowing between the anode electrode and the cathode electrode.

At this time, the red, green and blue light emitting layer are formed of different materials, respectively, and thus a separate gamma is applied to each of them.

SUMMARY OF THE INVENTION

It is an aspect of embodiments according to the present invention to provide an organic light emitting display in which gamma can be applied in accordance with color regardless of the sequence of data output from a data driver, even if a separate gamma by color is used, and a method for driving the same.

BRIEF DESCRIPTION OF THE DRAWINGS

The accompanying drawings, together with the specification illustrate exemplary embodiments of the present invention, and, together with the description, serve to explain the principles of the present invention.

DETAILED DESCRIPTION

Hereinafter, exemplary embodiments according to the present invention will be described with reference to the accompanying drawings.

Figure 1A:
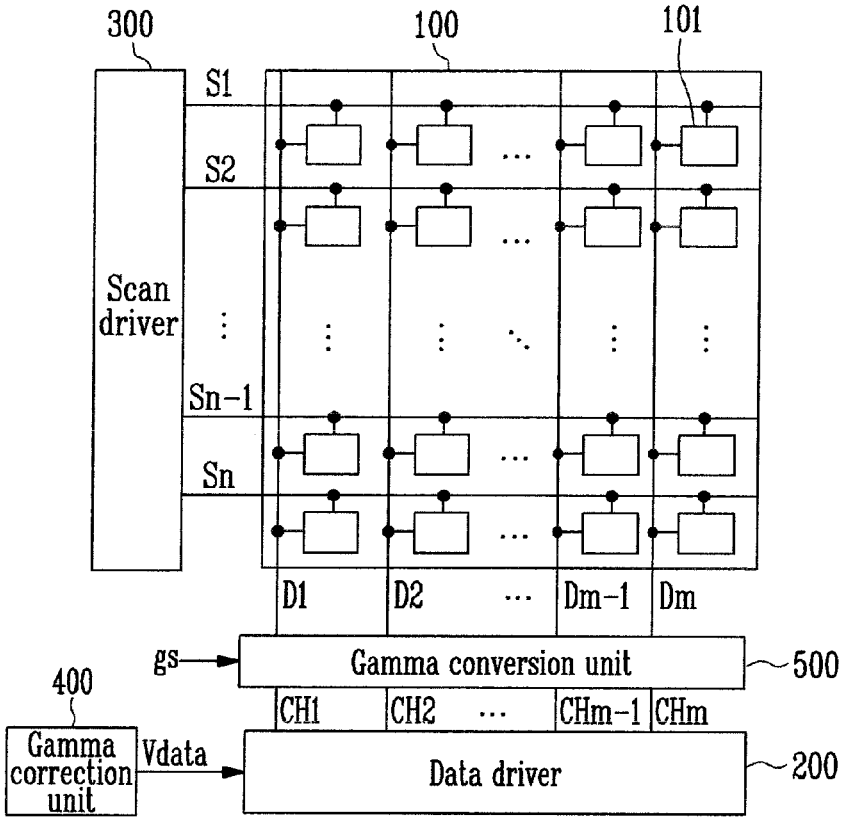
FIG. 1A is a structure view of an organic light emitting display according to an embodiment of the present invention.
Figure 1B:
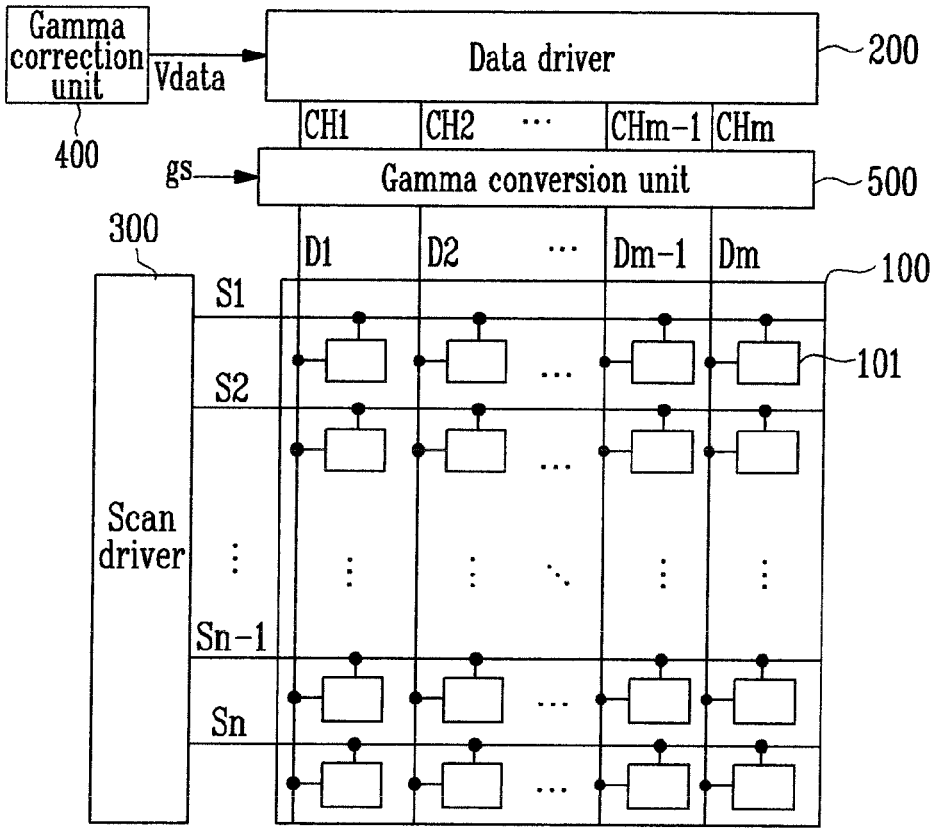
FIG. 1B is a structure view of an organic light emitting display according to an embodiment of the present invention.

FIGS. 1A and 1B are a structure view of an organic light emitting display according to an embodiment of the present invention. Referring to FIGS. 1A and 1B, the organic light emitting display includes a pixel unit 100, a data driver 200, a scan driver 300, a gamma correction unit 400, and a gamma conversion unit 500. and the data driver 200 and the gamma conversion unit 500 are positioned above the pixel unit 100 or below the pixel unit 100.

The pixel unit 100 includes a plurality of pixels 101, each of which includes an organic light emitting diode (not shown) emitting light in accordance with the flow of current. Also, the pixel unit 100 includes n scan lines S1, S2, . . . , Sn−1, and Sn formed in a row direction and transferring scan signals, and m data lines D1, D2, . . . , Dm−1, and Dm formed in a column direction and transferring data signals.

Also, the pixel unit 100 is driven by receiving first power and second power. Therefore, the pixel unit 100 emits light to display an image by current flowing in an organic light emitting diode by the scan signals, the data signals, the light emitting signals, the first power, and the second power. The plurality of pixels also include red, green and blue sub-pixels.

The data driver 200 generates data signals using image signals (R, G, and B data) having red, green, and blue components. The data driver 200 is coupled to the data lines D1, D2, . . . , Dm−1, and Dm in the pixel unit 100 via output channels CH1, CH2, . . . , CHm−1, and CHm outputting data signals to apply the data signals to the pixel unit 100. As for the output channels of the data driver to output the data signals, $1^{st}$, $4^{th}$, $7^{th}$, $10^{th}$, etc. output channels CH1, CH4, CH7, CH10, etc. are applied with red gamma, $2^{nd}$, $5^{th}$, $8^{th}$, $11^{th}$, etc. output channels CH2, CH5, CH8, CH11, etc. are applied with green gamma, and $3^{rd}$, $6^{th}$, $9^{th}$, $12^{th}$, etc. output channels CH3, CH6, CH9, CH12, etc. are applied with blue gamma.

The scan driver 300 generates scan signals and is coupled to the scan lines S1, S2, . . . Sn−1, and Sn to transfer the scan signals to a specific row of the pixel unit 100. A pixel 101 having received a scan signal receives a data signal output from the data driver 200, so that the pixel 101 receives voltage corresponding to the data signal.

The gamma correction unit 400 adjusts the voltage ratio of a data signal to a gray scale. Also, a separate gamma is employed for each of red, green, and blue because of different light emitting efficiencies of red, green, and blue light emitting layers. For example, as for expressing gray scales from 0 to 63, the voltage of a data signal corresponding to a 30 gray scale is set to 3.0V in red, 3.1 V in green, and 3.2V in blue because of different efficiencies of red, green, and blue.

The gamma conversion unit 500 allows a red gamma to be applied to red data signals transferred to a red pixel, a green gamma to be applied to green data signals transferred to a green pixel, and a blue gamma to be applied to blue data signals transferred to a blue pixel. That is, a data signal applied with the red gamma is transferred to the red pixel of the pixel unit, a data signal applied with the green gamma is transferred to the green pixel thereof, and a data signal applied with the blue gamma is transferred to the blue pixel thereof, regardless of the output channels of the data driver 200, outputting the data signals. The gamma conversion unit 500 operates according to gamma conversion signals gs.

Figure 2:
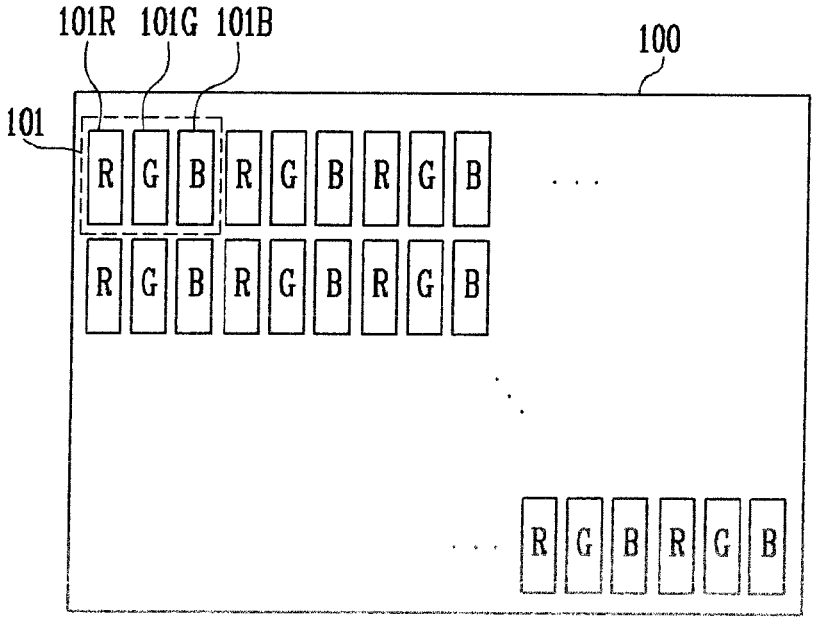
FIG. 2 is a structure view showing an arrangement of pixels of a pixel unit of the organic light emitting display of FIG. 1.

FIG. 2 is a structure view showing an arrangement of pixels of a pixel unit of the organic light emitting display of FIGS. 1A and 1B. Referring to FIG. 2, one pixel 101 of the pixel unit 100 includes three sub-pixels, which include red, green, and blue sub-pixels 101R, 101G, and 101B. The respective sub-pixels 101R, 101G, and 101B are coupled to the data lines to receive the data signals.

Also, the red, green, and blue sub-pixels 101R, 101G, and 101B are positioned in each pixel 101 in order from left to right.

The data driver 200 is coupled to the pixel unit 100 and outputs data signals in two manners: a first case in which red, green, and blue data signals are output by the sequence of $1^{st}$, $2^{nd}$, $3^{rd}$, etc. output channels CH1, CH2, CH3, etc. of the data driver 200; and a second case in which blue, green, and red data signals are output by the sequence of $1^{st}$, $2^{nd}$,$3^{rd}$, etc. output channels CH1, CH2, CH3, etc. of the data driver 200. One of the two cases as above is selected according to whether the data driver 200 is positioned above the pixel unit 100 or below the pixel unit 100, or whether the pixel unit 100 is a front light-emitting type or a rear light-emitting type.

In the first case, a first output channel is coupled with a pixel applied with a red gamma, receiving a red data signal, and expressing red. A second output channel is coupled with a pixel applied with a green gamma, receiving a green data signal, and expressing green. A third output channel is coupled with a pixel applied with a blue gamma, receiving a blue data signal, and expressing blue. In the second case, a first output channel is coupled with a pixel applied with a red gamma, receiving a blue data signal, and expressing blue. A second output channel is coupled with a pixel applied with a green gamma, receiving a green data signal, and expressing green. A third output channel is coupled with a pixel applied with a blue gamma, receiving a red data signal, and expressing red.

Therefore, in the first case, the pixels expressing red, green and blue are applied with a red, green and blue gamma, thereby displaying brightness proper for each color. In the second case, however, the pixels expressing red, green and blue are applied with a blue, green and red gamma, and thus the brightness proper for each color is not expressed.

In order to solve the problem, the gamma conversion unit 500 is coupled between the data driver 200 and the pixel unit 100, thereby allowing a data signal applied with a red gamma to be transferred to the pixel expressing red, allowing a data applied with green gamma to be transferred to the pixel expressing green, and allowing a data signal applied with blue gamma to be transferred to the pixel expressing blue.

Figure 3:
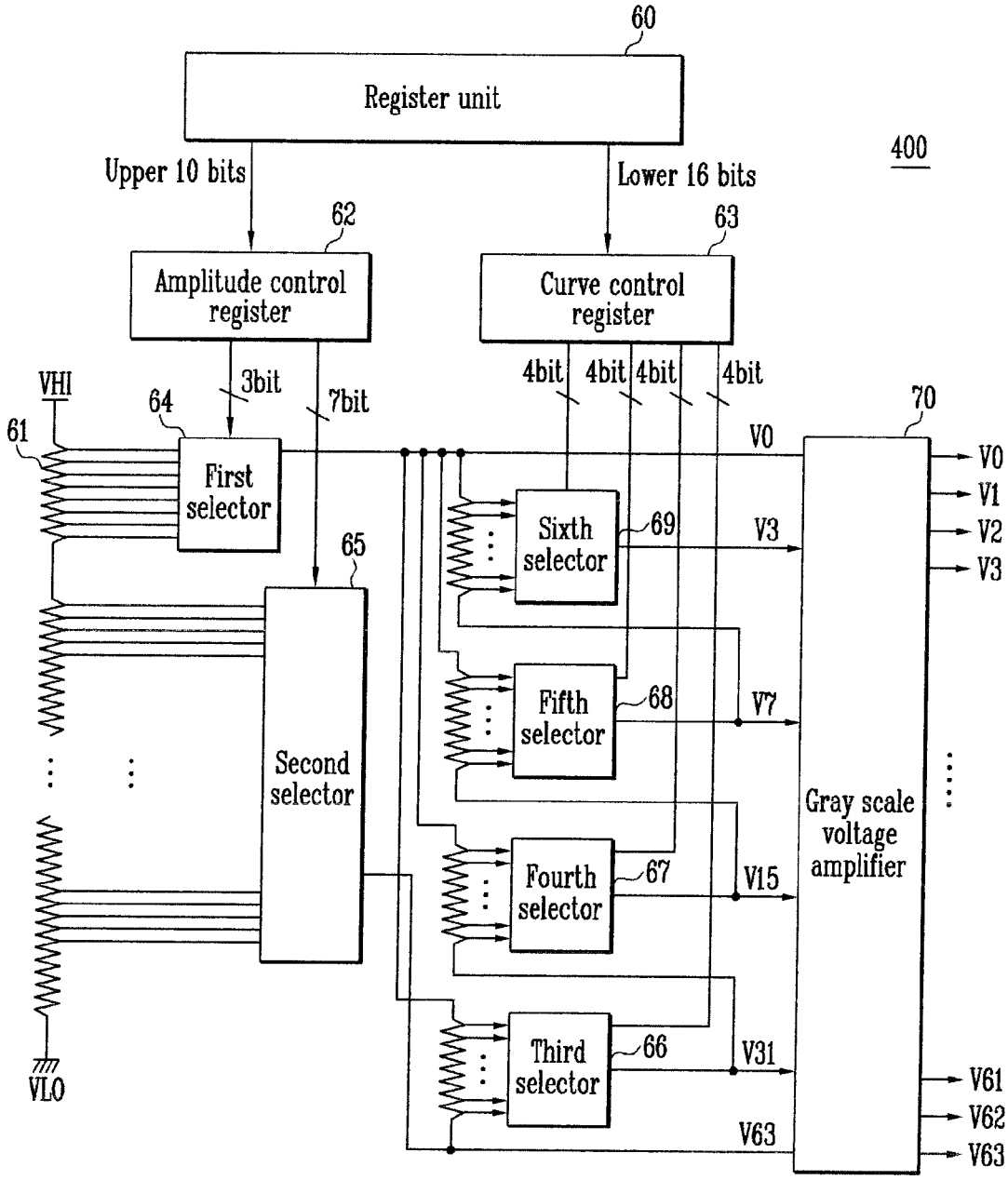
FIG. 3 is a circuit diagram showing a gamma correction unit employed in the organic light emitting display according to an embodiment of the present invention.

FIG. 3 is a circuit diagram showing a gamma correction unit employed in an organic light emitting display according to an embodiment of the present invention. Referring to FIG. 3, there are three gamma correction units 400 to be applied to red, green and blue data signals.

Each gamma correction unit 400 includes a register unit 60, a ladder resistor 61, an amplitude control register 62, a curve control register 63, a first selector 64 to sixth selector 69, and a gray scale voltage amplifier 70.

The register unit 60 stores a proper resister set value for red if the gamma correction unit 400 is a red gamma correction unit, stores a proper resister set value for green if the gamma correction unit 400 is a green gamma correction unit, and stores a proper resister set value for blue if the gamma correction unit 400 is a blue gamma correction unit. In other words, when the gamma correction unit 400 is coupled to the red pixel to perform gamma correction, the register unit 60 stores a register set value proper for the red pixel. When the gamma correction unit 400 is coupled to the green pixel to perform gamma correction, the register unit 60 stores a register set value proper for the green pixel. When the gamma correction unit 400 is coupled to the blue pixel to perform gamma correction, the register unit 60 stores a register set value proper for the blue pixel.

Among the register values stored in the register unit 60, the upper 10 bits are input to the amplitude control register 62 and the lower 16 bits are input to the curve control register 63, respectively, thereby being selected as a register set value.

The ladder resistor 61 has a configuration in which a plurality of variable resistors are coupled to each other in series between the uppermost level voltage VHI and the lowermost level voltage VLO, and a plurality of gray scale voltages are generated through the ladder resistor 61.

The amplitude control register 62 outputs 3-bit register set values to the first selector 64, and 7-bit register set values to the second selector 65. At this time, the number of selectable gray scales may be increased by increasing the number of the set bits, and a different gray scale voltage may be selected by changing the register set values.

The curve control register 63 outputs 4-bit register set values to the third selector 66 to the sixth selector 69, respectively. At this time, the register set values may be changed, and the selectable gray voltage may be controlled according to the register set values.

The amplitude control register 62 is input with the upper 10 bits register signals, and the curve control register 63 is input with the lower 16 bits register signals.

The first selector 64 selects a gray scale voltage corresponding to a 3-bit register set value in the amplitude control register 62, among a plurality of gray scale voltages distributed through the ladder resistor 61, and outputs the gray scale voltage as the uppermost gray scale voltage.

The second selector 65 selects a gray scale voltage corresponding to a 7-bit register set value in the amplitude control register 62, among a plurality of gray scale voltages distributed through the ladder resistor 61, and outputs the gray scale voltage as the lowermost gray scale voltage.

The third selector 66 distributes a voltage between the gray scale voltage output from the first selector 64 and the gray scale voltage output from the second selector 65 into a plurality of gray scale voltages through a plurality of resistance columns and selects a gray scale voltage corresponding to a 4-bit register set value to be output.

The fourth selector 67 distributes a voltage between the gray scale voltage output from the first selector 64 and the gray scale voltage output from the third selector 66 into a plurality of gray scale voltages through a plurality of resistance columns and selects a gray scale voltage corresponding to a 4-bit register set value to be output.

The fifth selector 68 selects and outputs a gray scale voltage corresponding to a 4-bit register set value among gray scale voltages between the first selector 64 and the fourth selector 67.

The sixth selector 69 selects and outputs a gray scale voltage corresponding to a 4-bit register set value among gray scale voltages between the first selector 64 and the fifth selector 68. A curve of an intermediate gray scale can be adjusted according to the register set values of the curve control register 63 through the operations as above, making it possible to adjust gamma properties with ease according to respective properties of light emitting elements. In order to allow the gamma curve property to become convex downwardly, a potential difference between gray scales is set to increase as a lower gray scale is represented. To the contrary, in order to allow the gamma curve property to become convex upwardly, the resistance value of each ladder resistor 61 is set to allow a potential difference between gray scales to be reduced as a lower gray scale is represented.

The gray scale voltage amplifier 70 outputs a plurality of gray scale voltages each corresponding to a plurality of gray scales to be displayed on the pixel unit 100. In FIG. 2, the output of the gray scale voltages corresponding to 64 gray scales has been represented.

Figure 4:
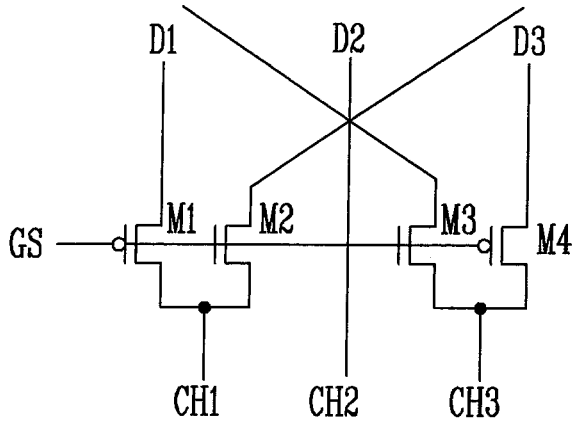
FIG. 4 is a circuit diagram showing a first embodiment of a gamma conversion unit employed in the organic light emitting display according to an embodiment of the present invention.

FIG. 4 is a circuit diagram showing a first embodiment of a gamma conversion unit employed in the organic light emitting display according to an embodiment of the present invention. Referring to FIG. 4, a gamma conversion unit 500 includes a first transistor M1, a second transistor M2, a third transistor M3, and a fourth transistor M4. It is illustrated that the first transistor M1 and the fourth transistor M4 are implemented as PMOS transistors, and the second transistor M2 and the third transistor M3 are implemented as NMOS transistors. However, if the first transistor M1 and the fourth transistor M4 are implemented as NMOS transistors, the second transistor M2 and the third transistor M3 may be implemented as PMOS transistors.

A source of the first transistor M1 is coupled to a first channel CH1 of a data driver 200, and a drain thereof is coupled to a first data line D1. A gate thereof is coupled to a gamma conversion signal line GS.

A source of the second transistor M2 is coupled to the first channel CH1 of the data driver 200, and a drain thereof is coupled to a third data line D3. A gate thereof is coupled to the gamma conversion signal line GS.

A source of the third transistor M3 is coupled to a third channel CH3 of the data driver 200, and a drain thereof is coupled to the first data line D1. A gate thereof is coupled to the gamma conversion signal line GS.

A source of the fourth transistor M4 is coupled to the third channel CH3 of the data driver 200, and a drain thereof is coupled to the third data line D3. A gate thereof is coupled to the gamma conversion signal line GS.

A second channel CH2 of the data driver 200 is directly coupled to a second data line D2.

If a gamma conversion signal in a low state is transferred through the gamma conversion signal line GS, the first transistor M1 and the fourth transistor M4 turn on, and the second transistor M2 and the third transistor M3 turn off. In other words, the first channel CH1 of the data driver 200 is coupled to the first data line D1, the second channel CH2 of the data driver 200 is coupled to the second data line D2, and the third channel CH3 of the data driver 200 is coupled to the third data line D3.

If a gamma conversion signal in a high state is transferred through the gamma conversion signal line GS, the first transistor M1 and the fourth transistor M4 turn off, and the second transistor M2 and the third transistor M3 turn on. In other words, the first channel CH1 of the data driver 200 is coupled to the third data line D3, the second channel CH2 of the data driver 200 is coupled to the second data line D2, and the third channel CH3 of the data driver 200 is coupled to the first data line D1.

Therefore, if the gamma conversion signal transferred through the gamma conversion signal line GS is in a low state, a red data is transferred to the first data line D1, a green data is transferred to the second data line D2, and a blue data is transferred to the third data line D3. If the gamma conversion signal transferred through the gamma conversion signal line GS is in a high state, a blue data is transferred to the first data line D1, a green data is transferred to the second data line D2, and a red data is transferred to the third data line D3.

Through the operations as above, a red sub-pixel 101R of the pixel unit 100 receives a data signal applied with the red gamma, a green sub-pixel 101G thereof receives a data signal applied with the green gamma, and a blue sub-pixel 101B thereof receives a data signal applied with the blue gamma.

Figure 5:
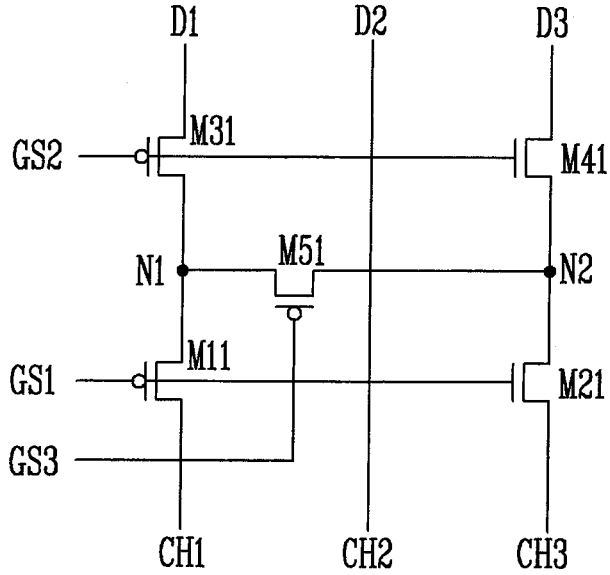
FIG. 5 is a circuit diagram showing a second embodiment of a gamma conversion unit employed in the organic light emitting display according to an embodiment of the present invention.

FIG. 5 is a circuit diagram showing a second embodiment of a gamma conversion unit employed in the organic light emitting display according to an embodiment of the present invention. Referring to FIG. 5, a gamma conversion unit 500 includes a first transistor M11, a second transistor M21, a third transistor M31, a fourth transistor M41, and a fifth transistor M51. Also, the first transistor M11, the third transistor M31, and the fifth transistor M51 are implemented as PMOS transistors, and the second transistor M21 and the fourth transistor M41 are implemented as NMOS transistors. Also, if the first transistor M11, the third transistor M31, and the fifth transistor M51 are implemented as NMOS transistors, the second transistor M21 and the fourth transistor M41 may be implemented as PMOS transistors.

A source of the first transistor M11 is coupled to a first channel CH1 of a data driver 200, and a drain thereof is coupled to a first node N1. A gate thereof is coupled to a gamma conversion signal line GS1.

A source of the second transistor M21 is coupled to a third channel CH3 of the data driver 200, and a drain thereof is coupled to a second node N2. A gate thereof is coupled to the gamma conversion signal line GS1.

A source of the third transistor M31 is coupled to the first node N1, and a drain thereof is coupled to a first data line D1. A gate thereof is coupled to a second gamma conversion signal line GS2.

A source of the fourth transistor M41 is coupled to the second node N2, and a drain thereof is coupled to a third data line D3. A gate thereof is coupled to the second gamma conversion signal line GS2.

A source of the fifth transistor M51 is coupled to the first node N1, and a drain thereof is coupled to the second node N2. A gate thereof is coupled to a third gamma conversion signal line GS3.

A second channel CH2 of the data driver 200 is directly coupled to a second data line D2.

If red, green, and blue data are output from the first channel CH1, the second channel CH2, and the channel CH3, and red, green, and blue pixels are coupled to the first data line D1, the second data line D2, and the third data line D3, the transistors operate as follows.

First, if a first gamma conversion signal and a second gamma conversion signal are in a low state, and a third gamma conversion signal is in a high state, the first transistor M11 and the third transistor M31 turn on, and the second transistor M21, the fourth transistor M41, and the fifth transistor M51 turn off. In such a state, the red data output from the first channel CH1 is transferred to the first data line D1. Then, the red data is transferred to the red pixel.

If a first gamma conversion signal, a second gamma conversion signal, and a third gamma conversion signal are in a high state, the first transistor M11, the third transistor M31, and the fifth transistor M51 turn off, and the second transistor M21 and the fourth transistor M41 turn on. In such a state, the blue data output from the third channel CH3 is transferred to the third data line D3. Then, the blue data is transferred to the blue pixel.

At this time, the second channel CH2 is directly coupled to the second data line D2, so that the green data is transferred to the green pixel.

If blue, green, and red data are output from the first channel CH1, the second channel CH2, and the channel CH3, and red, green, and blue pixels are coupled to the first data line D1, the second data line D2, and the third data line D3, the transistors operate as follows.

First, if a first gamma conversion signal and a third gamma conversion signal are in a low state, and a second gamma conversion signal is in a high state, the first transistor M11, the fourth transistor M41, and the fifth transistor M51 turn on, and the second transistor M21 and the third transistor M31 turn off. In such a state, the blue data output from the first channel CH1 is transferred to the third data line D3 via the first transistor M11, the fifth transistor M51, and the fourth transistor M41. Then, the blue data is thereby transferred to the blue pixel.

If a first gamma conversion signal is in a high state, and a second gamma conversion signal and a third gamma conversion signal are in a low state, the second transistor M21, the third transistor M31, and the fifth transistor M51 turn on, and the first transistor M11 and the fourth transistor M41 turn off. In such a state, the red data output from the third channel CH3 is transferred to the first data line D1 via the second transistor M21, the fifth transistor M51, and the third transistor M31. Then, the red data is thereby transferred to the red pixel.

At this time, the second channel CH2 is directly coupled to the second data line D2, so that the green data is transferred to the green pixel.

Through the operations as above, a red sub-pixel 101R of the pixel unit 100 receives a data signal applied with the red gamma, a green sub-pixel 101G thereof receives a data signal applied with the green gamma, and a blue sub-pixel 101B thereof receives a data signal applied with the blue gamma.

Figure 6:
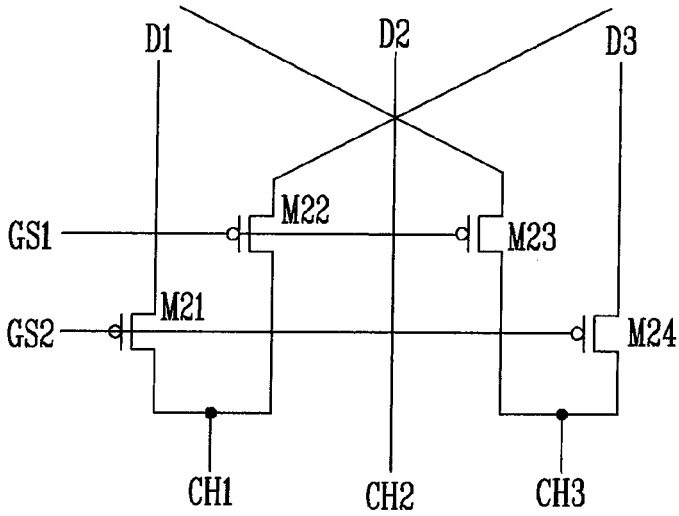
FIG. 6 is a circuit diagram showing a third embodiment of a gamma conversion unit employed in the organic light emitting display according to an embodiment of the present invention.

FIG. 6 is a circuit diagram showing a third embodiment of a gamma conversion unit employed in the organic light emitting display according to an embodiment of the present invention. Referring to FIG. 6, a gamma conversion unit 500 includes a first transistor M21, a second transistor M22, a third transistor M23, and a fourth transistor M24. Although it is illustrated that the first transistor M21 to the fourth transistor M24 are implemented as PMOS transistors, the first transistor M21 to the fourth transistor M24 may also be implemented as NMOS transistors.

A source of the first transistor M21 is coupled to a first channel CH1 of a data driver 200, and a drain thereof is coupled to a first data line D1. A gate thereof is coupled to a second gamma conversion signal line GS2.

A source of the second transistor M22 is coupled to the first channel CH1 of the data driver 200, and a drain thereof is coupled to a third data line D3. A gate thereof is coupled to a first gamma conversion signal line GS1.

A source of the third transistor M23 is coupled to a third channel CH3 of the data driver 200, and a drain thereof is coupled to the first data line D1. A gate thereof is coupled to the first gamma conversion signal line GS1.

A source of the fourth transistor M24 is coupled to the third channel CH3 of the data driver 200, and a drain thereof is coupled to the third data line D3. A gate thereof is coupled to the second gamma conversion signal line GS2.

A second channel CH2 of the data driver 200 is directly coupled to a second data line D2.

If a gamma conversion signal in a low state is transferred through the second gamma conversion signal line GS2, the first transistor M21 and the fourth transistor M24 turn on. If a gamma conversion signal in a high state is transferred through the first gamma conversion signal line GS1, the second transistor M22 and the third transistor M23 turn off. In other words, the first channel CH1 of the data driver 200 is coupled to the first data line D1, the second channel CH2 of the data driver 200 is coupled to the second data line D2, and the third channel CH3 of the data driver 200 is coupled to the third data line D3.

If a gamma conversion signal in a high state is transferred through the second gamma conversion signal line GS2, the first transistor M21 and the fourth transistor M24 turn off, and if a gamma conversion signal in a low state is transferred through the first gamma conversion signal line GS1, the second transistor M22 and the third transistor M23 turn on. In other words, the first channel CH1 of the data driver 200 is coupled to the third data line D3, the second channel CH2 of the data driver 200 is coupled to the second data line D2, and the third channel CH3 of the data driver 200 is coupled to the first data line D1.

Therefore, if the gamma conversion signal transferred through the second gamma conversion signal line GS2 is in a low state and the gamma conversion signal transferred through the first gamma conversion signal line GS1 is in a high state, a red data is transferred to the first data line D1, a green data is transferred to the second data line D2, and a blue data is transferred to the third data line D3. If the gamma conversion signal transferred through the second gamma conversion signal line GS2 is in a high state and the gamma conversion signal transferred through the first gamma conversion signal line GS1 is in a low state, a blue data is transferred to the first data line D1, a green data is transferred to the second data line D2, and a red data is transferred to the third data line D3.

Through the operations as above, a red sub-pixel 101R of the pixel unit 100 receives a data signal applied with the red gamma, a green sub-pixel 101G thereof receives a data signal applied with the green gamma, and a blue sub-pixel 101B thereof receives a data signal applied with the blue gamma.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a display region comprising a plurality of pixels, each pixel comprising at least two sub-pixels having different colors;

a data driver for outputting data signals to signal lines; and a data signal switch for receiving the data signals through the signal lines and transmitting the data signals through data lines to the sub-pixels, the data signal switch being configured to switch a correspondence between two of the signal lines and two of the data lines in accordance with a single gamma conversion signal, the two of the signal lines for transmitting two of the data signals to two of the sub-pixels in a same one of the pixels through the two of the data lines, a first signal line of the two of the signal lines for transmitting a first data signal of the two of the data signals to one of a first data line or a second data line of the two of the data lines while a second signal line of the two of the signal lines transmits a second data signal of the two of the data signals to another of the first data line or the second data line, wherein the data signal switch comprises a first switch and a second switch each having a first terminal electrically connected to the first signal line and a third switch and a fourth switch each having a first terminal electrically connected to the second signal line while the first signal line transmits the first data signal to the one of the first data line or the second data line and the second signal line transmits the second data signal to the other of the first data line or the second data line, the first, second, third, and fourth switches being controlled by the gamma conversion signal, and wherein the first and third switches each have a second terminal electrically connected to the first data line and the second and fourth switches each have a second terminal electrically connected to the second data line while the first signal line transmits the first data signal to the one of the first data line or the second data line and the second signal line transmits the second data signal to the other of the first data line or the second data line.

2. The organic light emitting display of claim 1, further comprising a gamma correction unit for providing red, green and blue gamma data to the data driver, wherein the data driver is configured to receive red, green and blue image data, and to apply the red, green and blue gamma data, respectively, to the red, green and blue image data to generate the data signals.

3. The organic light emitting display of claim 1, wherein the data driver is located at a first side of the display region or at a second side of the display region, wherein the gamma conversion signal applied to the data signal switch when the data driver is located at the first side of the display region is different from the gamma conversion signal applied to the data signal switch when the data driver is located at the second side of the display region.

4. The organic light emitting display of claim 1, wherein the first, second, third and fourth switches are configured to receive the gamma conversion signal, and wherein the first data signal from the first signal line and the second data signal from the second signal line are switched between the first and second data lines in accordance with the gamma conversion signal.

5. The organic light emitting display of claim 1, wherein the first and fourth switches comprise first type transistors and the second and third switches comprise second type transistors.

6. The organic light emitting display of claim 1, wherein the at least two sub-pixels comprise red, green and blue sub-pixels, and wherein the data signal switch is configured to switch the data signals applied to the red and blue sub-pixels in accordance with the gamma conversion signal.

7. A method for applying appropriate gamma correction to data signals of a display device comprising a plurality of pixels, each pixel comprising a first sub-pixel connected to a first data line electrically connected to a first switch and a third switch, a second sub-pixel, and a third sub-pixel connected to a second data line electrically connected to a second switch and a fourth switch, the method comprising:

applying a first gamma correction factor to a first color signal of the data signals to generate a first data signal to be applied to one of the first sub-pixel or the third sub-pixel;

applying a second gamma correction factor to a second color signal of the data signals to generate a second data signal to be applied to the second sub-pixel;

applying a third gamma correction factor to a third color signal of the data signals to generate a third data signal to be applied to another of the first sub-pixel or the third sub-pixel;

transmitting the first data signal through a first signal line switchably connected to the first or second data lines by the first or second switches, respectively, of the same one of the pixels when the first data line is electrically connected to the first and third switches and the second data line is electrically connected to the second and fourth switches;

transmitting the third data signal through a second signal line switchably connected to the first or second data lines by the third or fourth switches, respectively, of the same one of the pixels when the first data line is electrically connected to the first and third switches and the second data line is electrically connected to the second and fourth switches; and switching the first and third data signals between the first and third sub-pixels of the same one of the pixels in accordance with a single gamma conversion signal by switching the connection between the first and second signal lines and the first and second data lines in accordance with the gamma conversion signal, the first, second, third and fourth switches being controlled by the gamma conversion signal.

8. The method of claim 7, wherein the first, second and third sub-pixels comprise red, green and blue sub-pixels, and the switching comprises switching the first and third data signals between the red and blue sub-pixels.

9. The method of claim 7, wherein the switching comprises selectively turning on or off a plurality of transistors between the data signals and the first and third sub-pixels.

* * * * *